US005090213A

United States Patent [19]

Glassman

[11] Patent Number: 5,090,213

[45] Date of Patent: Feb. 25, 1992

[54] CONTAINER FOR LIQUID HAVING A COOLING CAPACITY

[76] Inventor: Neil D. Glassman, 1418 Marshall La., Meadowbrook, Pa. 19046

[21] Appl. No.: 641,599

[22] Filed: Jan. 15, 1991

[51] Int. Cl.[5] ..... F25D 3/08

[52] U.S. Cl. ..... 62/457.3; 62/457.2

[58] Field of Search ..... 62/457.1, 457.2, 457.3, 62/457.4, 371, 529

[56] References Cited

U.S. PATENT DOCUMENTS

| | | | |
|---|---|---|---|
| 1,526,386 | 2/1925 | Smith et al. | 62/371 |
| 2,187,558 | 1/1940 | Kushima | 62/457.2 |
| 2,315,425 | 3/1943 | Hill et al. | 62/371 |
| 2,526,165 | 10/1950 | Smith | 62/457.3 |
| 2,926,508 | 3/1960 | Moon | 62/457.3 |
| 3,494,143 | 2/1970 | Barnett et al. | 62/457.1 |
| 3,603,106 | 9/1971 | Ryan et al. | 62/371 |
| 3,995,445 | 12/1976 | Huskins | 62/457.1 |
| 4,485,636 | 12/1984 | Hilado | 62/457.3 |
| 4,618,066 | 10/1986 | Vail | 215/12 R |
| 4,691,664 | 9/1987 | Crowell | 119/61 |
| 4,798,063 | 1/1989 | Rimmer | 62/371 |

*Primary Examiner*—Albert J. Makay
*Assistant Examiner*—William C. Doerrler
*Attorney, Agent, or Firm*—Weiser & Stapler

[57] ABSTRACT

A liquid-receiving container is generally comprised of an inner cup-shaped portion for receiving a liquid such as a beverage, and an outer cup-shaped portion for being grasped by the user. The inner and outer cup-shaped portions are substantially completely separated from one another but for interconnection along their respective rims. The inner cup-shaped portion is further provided with a projection for receiving an appropriate refrigerant or cooling medium, enclosed by a cover plate for completing the structure.

6 Claims, 1 Drawing Sheet

CONTAINER FOR LIQUID HAVING A COOLING CAPACITY

BACKGROUND OF THE INVENTION

The present invention relates generally to containers for receiving liquids, primarily beverages for consumption, and more particularly, to beverage-receiving containers having a capacity for cooling the liquids which they receive.

For example, U.S. Pat. Nos. 2,187,558 and 2,526,165 disclose containers for receiving a liquid which incorporate a centrally disposed projection for receiving a cooling medium. The cooling medium then operates to reduce and/or maintain the temperature of the liquid received by the container. Later improvements to this basic concept include the use of solid gel refrigerants for cooling purposes, as disclosed in U.S. Pat. Nos. 4,485,636 and 4,691,664, and the provision of insulating structures for separating the cooled inner portions of the container from the outer surfaces used in grasping the container, as disclosed in U.S. Pat. Nos. 4,485,636 and 4,798,063.

These and other liquid-receiving containers which have been developed for similar purposes suffer from certain disadvantages which have limited their utility. First, although many provide a limited degree of insulation between the inner, liquid-receiving portions of the container and the outer, surface portions for grasping the container, the degree of insulation achieved has been such as to promote relatively rapid warming of the contained liquid. This is often promoted by mechanical interconnections needed to maintain the structural integrity of the container. Second, insulated containers of this general type are often characterized by a significant number of components for assembly, which components often constitute relatively complex molded forms. This tends to increase the overall cost of the container, limiting consumer acceptance. These two disadvantages tend to combine to provide a container which, while effective in providing limited cooling over an extended period of time, is overly complex and costly.

SUMMARY OF THE INVENTION

It is therefore the primary object of the present invention to provide an improved container for receiving a liquid and for maintaining the received liquid at a desired temperature for a significant period of time.

It is also an object of the present invention to provide a liquid-receiving container of this general type which substantially completely isolates the inner, liquid-receiving portions of the container from the outer, surface portions of the container which are to be grasped by the user.

It is also an object of the present invention to provide a liquid-receiving container of this general type which is simplified in construction, both in the molded shapes which are employed and in the overall methods which are used to assemble such molded shapes.

These and other objects are achieved in accordance with the present invention by providing a liquid-receiving container which is generally comprised of an inner cup-shaped portion for receiving a liquid such as a beverage, and an outer cup-shaped portion for being grasped by the user, which inner and outer cup-shaped portions are substantially completely separated from one another but for interconnection along their respective rims. The inner cup-shaped portion is further provided with a projection for receiving an appropriate refrigerant or cooling medium, which is enclosed in straight-forward fashion by a cover plate for completing the inner cup-shaped portion.

The inner and outer cup-shaped portions have simplified shapes which greatly facilitate their molding. The cover plate for the inner cup-shaped portion may take the form of a simple disk. Assembly of the container is accomplished in straight-forward fashion by filling the projection of the inner cup-shaped portion with an appropriate refrigerant or cooling medium, and sealing the cover plate to the projection of the inner cup-shaped portion, completing the subassembly. The inner and outer cup-shaped portions are then joined at their rims, suspending the inner cup-shaped portion within the outer cup-shaped portion so that the only contacting surfaces of the resulting assembly are the respective rims of the inner and outer cup-shaped portions.

Use of the assembled container is also straight-forward, since all that needs to be done is to refrigerate the cooling medium (e.g., placement of the container in a conventional FREEZER or the like), readying the container for use. In use, the desired liquid is poured into the inner cup-shaped portion, with the cooling medium then serving to maintain the temperature of the liquid, as desired. This is facilitated by the substantial separation developed between the inner and outer cup-shaped portions, in addition to providing an outer surface for grasping the container which is not uncomfortably cool to the touch, as with prior containers of this general type.

For further detail regarding a container produced in accordance with the present invention, reference is made to the detailed discussion which is provided below, taken in conjunction with the following illustrations.

BRIEF DESCRIPTION OF THE DRAWINGS

In the views provided, like reference numbers denote similar structure.

DETAILED DESCRIPTION OF A PREFERRED EMBODIMENT

Figure 2:
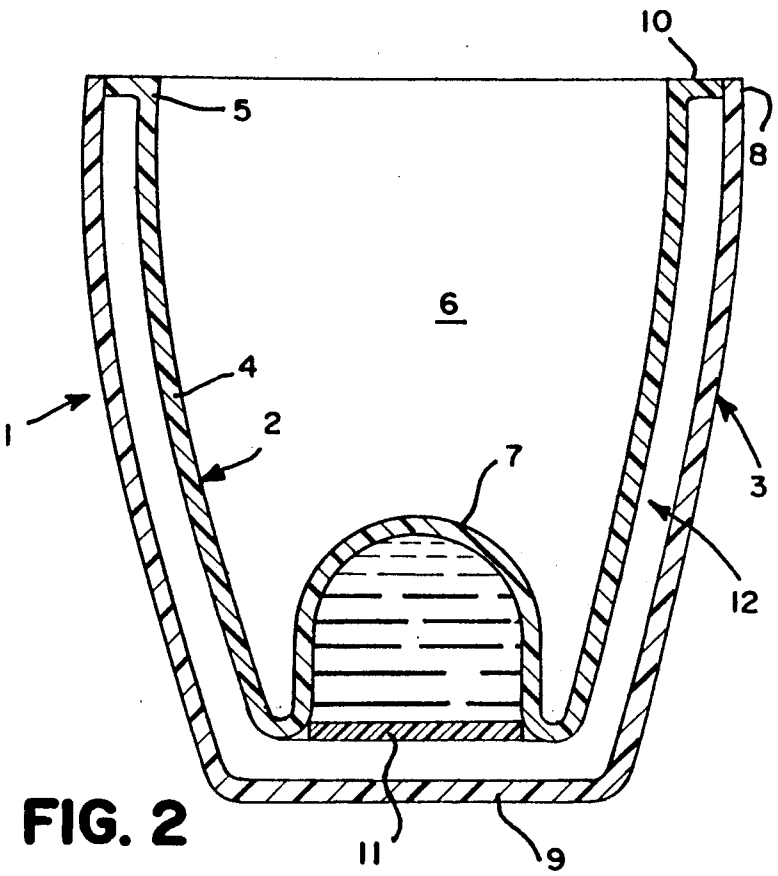
FIG. 2 is a cross-sectional view of the liquid-receiving container of FIG. 1.
Figure 1:
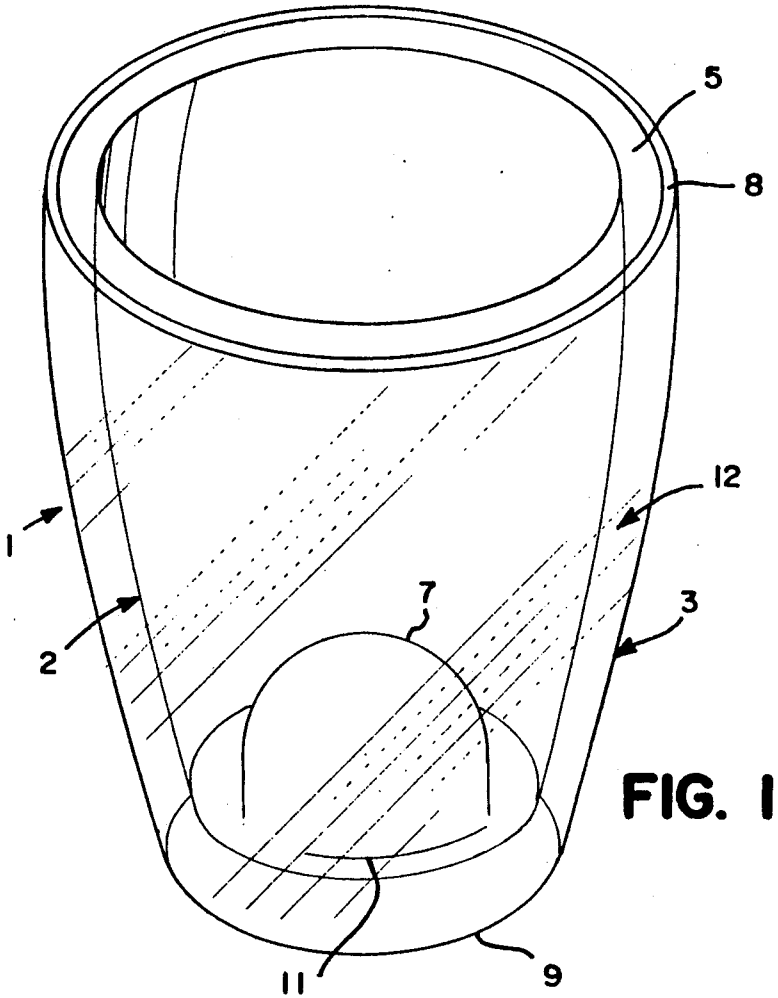
FIG. 1 is a perspective view of the liquid-receiving container of the present invention.

FIGS. 1 and 2 illustrate a container 1 for receiving a desired liquid, such as a beverage or the like, in a manner which operates to maintain the temperature of the received liquid at a desired temperature. It is to be understood that the container 1 of the present invention is suited to receiving any of a number of different types of liquids, both beverages for consumption and other liquids which are to be maintained at a desired temperature for an extended period of time. This can include liquids (e.g., soft drinks and the like) which are to be cooled, as well as liquids (e.g., coffee, tea, soups, etc.) which are to be warmed, depending upon the temperature-maintaining medium which is employed.

The container 1 is generally comprised of an inner cup-shaped portion 2 and an outer cup-shaped portion 3. To be noted is that the inner and outer portions 2, 3 generally take the shape of a conventional cup for receiving the desired liquid. This is preferred due to its universal application, as well as its comfort and convenience in use. However, it should be understood that any of a number of other overall shapes may be adopted depending upon the particular application and/or according to need. The remainder of this disclosure will proceed to describe a preferred container 1 to be used in cooling a liquid, and having inner and outer portions 2, 3 with generally cup-shaped configurations, it being understood that modification well within the skill of the ordinary artisan may be employed to accommodate other applications.

The inner portion 2 is generally defined by a wall 4, the upper end of which terminates at a rim 5, and the base of defined by the inner portion 2, to develop a coolant receiving closure 7 which will be discussed more fully below. The outer portion 3 is also generally defined by a wall 5, the upper end of which terminates at a rim 8, and the base 9 of which is formed in conventional manner.

To be noted is that in the configuration shown, the rim 8 of the outer portion 3 includes no projecting structure, while the rim 5 of the inner portion 2 incorporates an annular projection, or flange 10. It is also possible for the rim 5 of the inner portion 2 to be free of projecting structure, and to provide a flange on the rim 8 of the outer portion 3, if desired. Alternatively, both the inner and outer portions 2, 3 could be provided with a flange extending from their respective rims 5, 8, providing a mating structure for interconnection as will be discussed more fully below. However, for simplification in fabrication, it is preferred for the outer portion 3 to be formed without a flange, since this permits the outer portion 3 to be molded as a simple cup-shaped structure of otherwise conventional configuration.

In manufacture, steps are taken to mold the inner portion 2 and the outer portion 3 to their desired shapes, preferably from available plastics suited to use in containing beverages and the like. Important to note here is the structural simplicity of the inner and outer portions 2, 3, which serves to facilitate the molding process and reduce costs. In assembly, steps are taken to fill the closure 7 of the inner portion 2 with an appropriate refrigerant or cooling medium. Any of a number of cooling media may be used for this purpose. However, the use of solid gel-type refrigerants (e.g., of the fluorinated hydrocarbon type) is preferred for this purpose. Thereafter, the filled closure 7 is completed with a disk-shaped cover plate 11, retaining the refrigerant within the closure 7. Lastly, steps are taken to join the inner portion 2 to the outer portion 3. This is advantageously accomplished by affixing the rim 8 of the outer portion 3 to the flange 10 of the inner portion 2 using any of a variety of commercially available adhesives, or known welding techniques.

The resulting container 1 provides an appropriate cavity 6 for receiving a liquid, which can then be brought to and/or maintained at a desired (cool) temperature through operation of the refrigerant contained within the closure 7 of the inner portion 2. Assisting in maintaining this desired temperature is the insulating annular space 12 developed between the inner portion 2 and the outer portion 3, which are fully separated from one another but for the interconnection between the rim 8 of the outer portion 3 and the flange 10 of the inner portion 2. This additionally operates to prevent substantial cooling of the outer portion 3, making the surface of the outer portion 3 more comfortable for grasping by the user. This can be accomplished with simple plastic moldings, and without the need for additional insulation materials. Important to note is that the closure 7 of the inner portion 2 is formed as an integral structure with the wall 4 of the inner portion 2, avoiding any seams in the resulting structure which could promote merging of the liquid contained within the cavity 6 and the refrigerant contained within the closure 7, thereby avoiding the potential for contamination of the contained liquid.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. A container for receiving a liquid, consisting essentially of:

a cup-shaped inner portion for receiving the liquid, having a rim and a closure for receiving a means for maintaining the liquid at a desired temperature; and a cup-shaped outer portion having a rim and a surface for grasping by a user;

wherein the rim of the inner portion is attached to the rim of the outer portion so that the only interconnection between the inner portion and the outer portion is the attached rim of the inner portion and rim of the outer portion, separating the inner portion and the outer portion from each other to define a fully open space between surface and base portions of the inner portion and surface and base portions of the outer portion, thereby isolating the surface for grasping by the user from the inner portion for receiving the liquid and for maintaining the liquid at the desired temperature.

2. The container of claim 1 wherein at least one of said rims includes a projecting flange for separating the rim of the inner portion from the rim of the outer portion.

3. The container of claim 1 wherein the liquid is to be cooled, and wherein said maintaining means is a solid gel-type refrigerant.

4. The container of claim 1 wherein the closure for receiving the maintaining means includes a cover plate for completing the closure.

5. The container of claim 4 wherein the closure extends into the liquid-receiving portion of the inner portion of the container.

6. The container of claim 1 wherein the open space is air-filled.

* * * * *